United States Patent [19]

Herrick et al.

[11] 4,077,120

[45] Mar. 7, 1978

[54] DRY SHAVER WITH FLOATING PERIPHERALLY SUPPORTED SHEAR PLATE

[75] Inventors: Wallace D. Herrick, Grand Rapids; Robert A. Yonkers, Grandville, both of Mich.

[73] Assignee: Bissell, Inc., Grand Rapids, Mich.

[21] Appl. No.: 271,798

[22] Filed: Jul. 14, 1972

[51] Int. Cl.[2] ..... B26B 19/14; B26B 19/04

[52] U.S. Cl. ..... 30/43.5

[58] Field of Search ..... 30/43.4, 43.5, 43.6, 30/346.51, 43.1

[56] References Cited

U.S. PATENT DOCUMENTS

| | | | |
|---|---|---|---|
| 2,900,720 | 8/1959 | Starre | 30/43.5 |
| 2,952,908 | 9/1960 | Starre | 30/346.51 X |
| 3,399,453 | 9/1968 | Biesma | 30/43.6 |
| 3,694,915 | 10/1972 | Beusink | 30/43.5 X |
| 3,715,803 | 2/1973 | Tyler | 30/43.5 |

*Primary Examiner*—Gary L. Smith

*Attorney, Agent, or Firm*—Andrus, Sceales, Starke & Sawall

[57] ABSTRACT

A dry rotary shaver having a floating shear plate which is supported beneath its periphery by resilient spring means. The spring support is fixed within the shaver head, prevents shear plate rotation, and acts as a means to retain the shear plate and rotary cutting element in place when the shaver head is removed from the shaver housing. Furthermore, the spring support may incorporate stop means to prevent hang up of the shear plate on the shaver opening in the event the shear plate is forceably pressed inwardly, as by a finger.

19 Claims, 8 Drawing Figures

Fig. 1
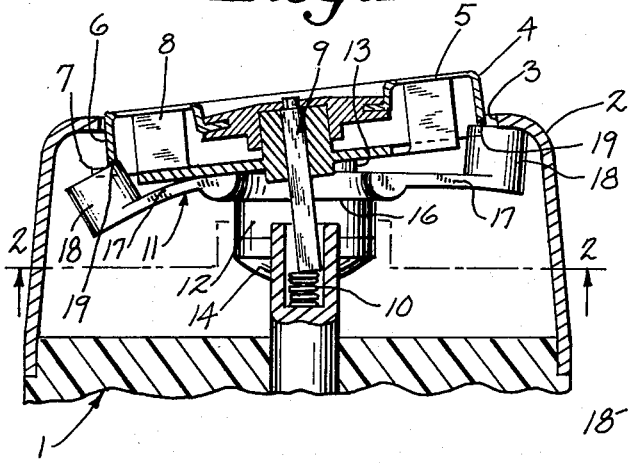
Fig. 2
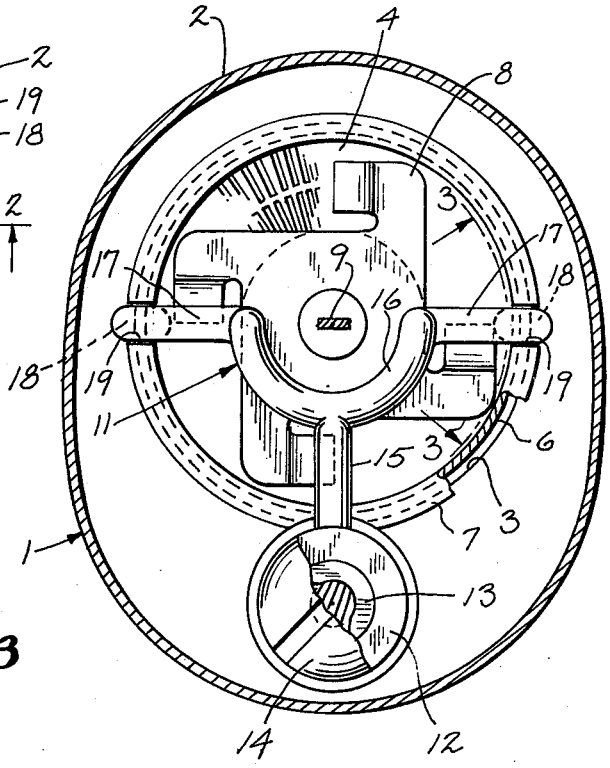
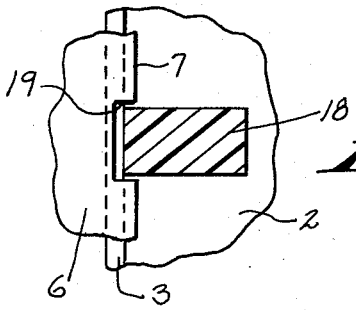
Fig. 3
Fig. 4
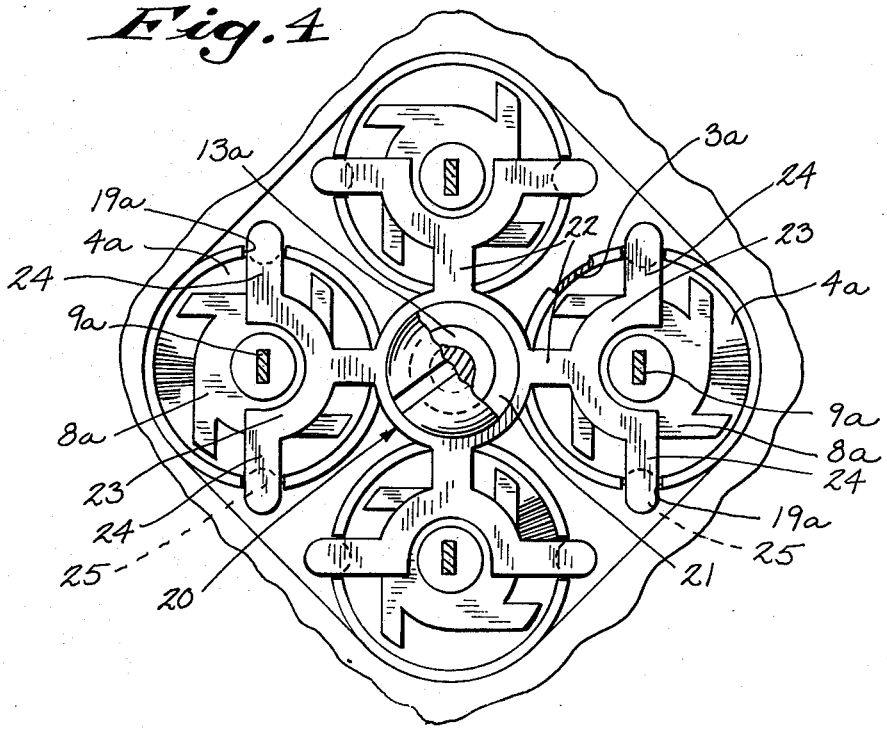

DRY SHAVER WITH FLOATING PERIPHERALLY SUPPORTED SHEAR PLATE

BACKGROUND OF THE INVENTION

This invention relates to a dry shaver with floating peripherally supported shear plate.

In recent years, dry shavers utilizing a rotary cutting action have become very popular. Such shavers have normally included a shear plate and a rotary cutting element therebeneath for removing hairs extending through the plate. Some shavers of this type have had a fixed shear plate, while others have incorporated a floating shear plate supported centrally by the cutter member. An example of this latter type is shown in U.S. Pat. No. 2,900,720, issued to Starre et al. on Aug. 25, 1959 and entitled "Dry Shaver with a Self Adjusting Shear Plate and Rotary Cutter."

It has always been desirable to make a dry shaver which will give the closest shave possible. The closeness of the shave has been dependent on a number of factors, and especially on the thinness of the shear plate. Over the years, various improvements in technology have made it possible to manufacture shear plates of increasingly thinner gauge materials, and the quality of shaving results has thus gradully improved.

However, it has been found that extremely thin floating shear plates do not always give completely satisfactory results. This is believed partially due to the fact that their sole support has been the centrally disposed cutter blade. While it would not be particularly difficult to provide additional support for a fixed shear plate, to the knowledge of the inventors no way has previously been found to give extra support to a floating shear plate to prevent undesirable flexing thereof.

In addition, previous dry rotary shaver head structures, such as in the aforementioned U.S. Pat. No. 2,900,720, have had certain other disadvantages. For example, disassembly of the head portion of the shaver has usually freed the cutting member and shear plate so they could easily fall out.

SUMMARY OF THE INVENTION

The present invention solves the aforementioned problems, and provides a dry shaver wherein the floating shear plate is supported beneath its periphery by resilient spring means. The spring support is fixed within the shaver head, prevents shear plate rotation, and acts as a means to retain the shear plate and rotary cutting element in place when the shaver head is removed from the shaver housing. Furthermore, the spring support may incorporate stop means to prevent hang up of the shear plate on the shaver opening in the event the shear plate is forceably pressed inwardly, as by a finger.

DESCRIPTION OF THE DRAWINGS

The accompanying drawings illustrate the best mode presently contemplated by the inventors for carrying out the invention.

In the drawings:

FIG. 1 is a vertical section of a portion of a single head dry rotary shaver constructed in accordance with the invention;

FIG. 2 is a transverse section taken on line 2—2 of FIG. 1;

FIG. 3 is an enlarged sectional view taken on line 3—3 of FIG. 2;

FIG. 4 is a view similar to FIG. 2 and showing a spring support of a generally similar type for a four head shaver;

DESCRIPTION OF THE PREFERRED EMBODIMENTS

Figure 5:
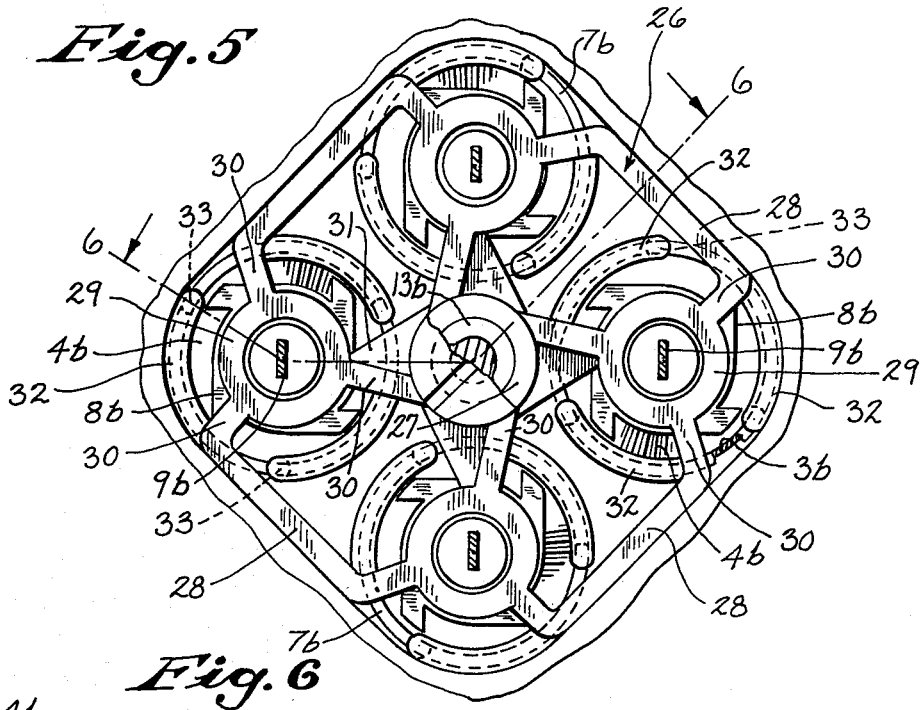
FIG. 5 is a view similar to FIG. 2 and showing another form of spring support for a four head shaver.

The concepts of the invention may be utilized in a dry rotary shaver having a single shear plate or having any desirable plurality thereof.

FIGS. 1-3 illustrate one form of the invention as applied to a shaver with one shear plate. As shown therein, the shaver includes a housing 1 having a removable head 2 which is provided with a suitable annular transverse opening 3 therein. Opening 3 is adapted to receive a floating annular shear plate 4 having an upper transverse shaving face 5 which merges into a cylindrical wall 6 which in turn terminates at its lower edge in a peripheral flange 7 of a larger diameter than the opening. Shear plate 4 is installed in opening 3 so that flange 7 is disposed beneath the opening whereby the edge portion of the latter acts as an upper stop.

A rotary cutting member 8 is mounted on the end of a floating drive shaft 9 of any suitable well-known type and is biased into central supporting engagement with shear plate 4, as by a spring 10.

In accordance with the invention, means are provided to support shear plate 4 beneath its peripheral portion for floating axial and/or tilting movement, with the peripheral portion freely resting on the supporting means. For this purpose, a unitary transverse support member 11 is incorporated within the head. As shown, member 11 is disposed generally parallel to and beneath shaving face 5 and includes an annular boss 12 which is mounted on a hub-like member 13 within head 2. A screw 14 threadably extends into hub 13, the head of which fixedly holds boss 12 and support member 11 in place. A compound element extends outwardly from boss 12 and comprises a straight portion 15, the outer end of which connects with the center of a curved semi-circular portion 16 which partially surrounds but is free of drive shaft 9. A pair of oppositely disposed flexible resilient spring arms 17 extend horizontally from the ends of portion 16 and are adapted to provide a multi-point support for the shear plate periphery, as well as providing means to lock plate 4 against rotation. For this purpose, the outer ends of arms 17 are provided with upwardly extending projections or lugs 18 which are received in appropriate notches 19 cut into flanges 7 and which may extend slightly into wall 6. See FIG. 3.

Arms 17 thus provide a spring loaded floating suspension for shear plate 4, with lugs 18 being tiltable with and supporting the peripheral plate portion; and also interlocking cooperating with notches 19 to lock the plate against rotation without interfering with its tilting action.

FIG. 4 illustrates an embodiment of the invention somewhat similar to the previously-described embodiment, except that the shaver is adapted to have a multiplicity of shear plates, namely four. As shown, these four shear plates **4*a* are mounted in openings 3*a*, and each have a cutting member 8***a* mounted on a suitably driven individual floating drive shaft 9*a*. The support member 20 includes a central boss 21 which is fixedly mounted, as before, on hub 13*a*. Boss 21 supports four annularly spaced compound elements, each of which includes a straight portion 22, semi-circular portion 23 and a pair of spring arms 24 having shear plate supporting and locking lugs 25 at their outer ends which enter and interlock with notches 19*a* in the plates.

In the embodiments of FIGS. 1–4, excessive inward pressure on a shear plate, as by a finger, may occasionally cause a shear plate to hang up on the edge of the head opening 3 or 3*a*. The invention therefore also contemplates the inclusion of stop means on, or forming part of, the support member to limit inward axial or tilting movement while retaining the desired floating action to the degree necessary for proper shaving results.

Figure 6:
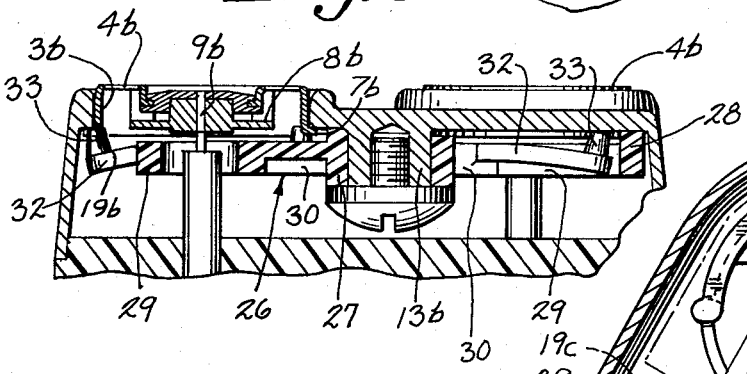
FIG. 6 is a vertical section taken on line 6—6 of FIG. 5.

Referring to FIGS. 5 and 6, there is again shown a dry rotary shaver having four shear plates 4*b* mounted in suitable openings 3*b*, with each shear plate having a cutting member 8*b* mounted on a suitably driven floating drive shaft 9*b*. The shaver head also includes a centrally disposed hub 13*b*. In this instance, the support member 26 also includes a central boss 27 which is adapted to be fixedly mounted on hub 13*b*.

Member 26 is somewhat different in configuration and design than the previously described members. The member is shown as generally rectangular with a plurality of segmental straight outer side portions 28. Means are provided to connect side portions 28 to central boss 27. For this purpose, a plurality of drive shaft surrounding or encircling rings 29 are spaced radially outwardly from boss 27 and are positioned generally diagonally within the support structure. Three connector arms 30 radiate outwardly from each ring 29, with one arm being connected generally tangentially to boss 27. The other two arms 30 connect to the ends of adjacent segmental side portions 28.

Members 27, 28, 29 and 30 are of substantial thickness and form a substantially rigid non-yielding structure which acts as a shear plate stop, as will be described. If desired, connectors 31 can join the inner end portions of arms 30 to further rigidify the structure.

As with the prior embodiments, support member 26 includes means to floatingly support each shear plate 4*b*. For this purpose, a curved spring arm 32 extends from the outer end portion of each connector arm 30. Arms 32 surround each ring 29 on the same radius, which coincides with the radius of the shear plates 4*b*. Arms 32 are substantially thinner than the rigid members 27–30, and are thus flexibly yielding. Lugs 33 on the outer ends of spring arms 32 enter and interlock with the usual notches 19*b* in the peripheral portions of shear plates 4*b*.

While arms 32 floatingly support each shear plate, the rigid portion of the structure acts as a multi-point stop for limiting inward shear plate movement. Thus excessive inward pressure will cause the flange 7*b* of shear plate 4*b* to engage one or more of the rigid members 28 or 30.

Figure 7:
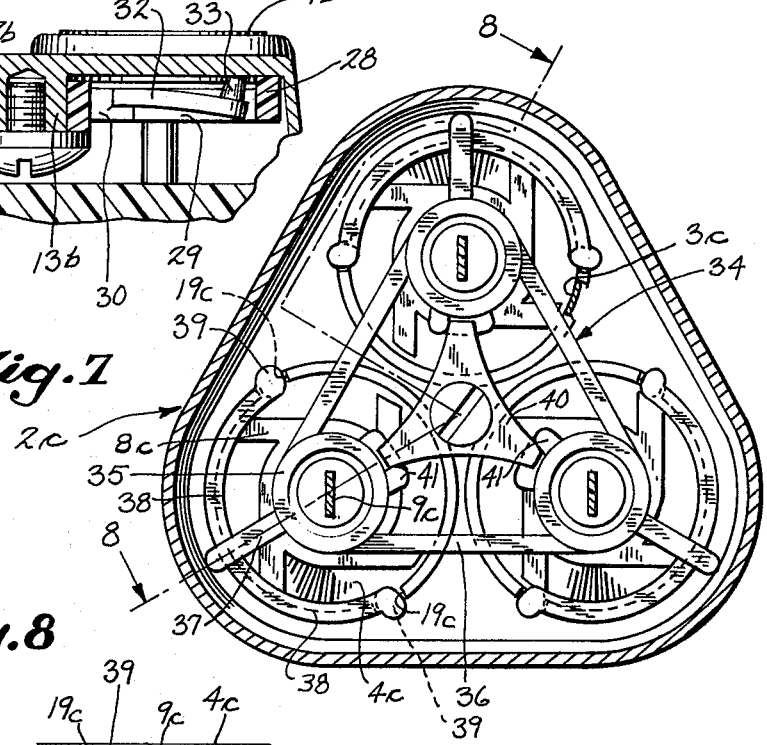
FIG. 7 is a view similar to FIG. 2 and showing a form of spring support as applied to a three head shaver.
Figure 8:
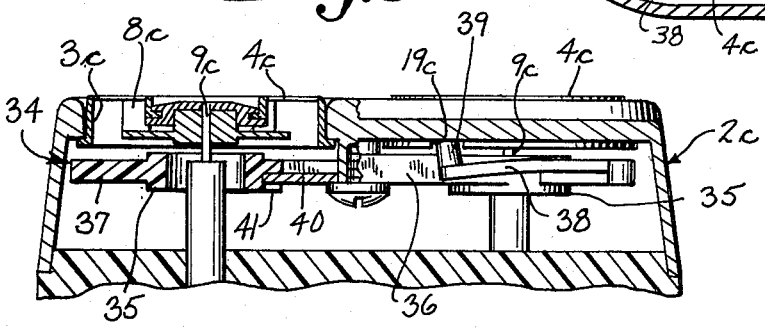
FIG. 8 is a vertical section taken on line 8—8 of FIG. 7.

Another embodiment of the invention is shown in FIGS. 7 and 8 and illustrates a shaver having three shear plates 4*c* which are also mounted in suitable openings 3*c*, with each shear plate having a cutting member 8*c* mounted on a suitably driven floating drive shaft 9*c*. The support member 34 eliminates the hub-boss connection to the shaver head and comprises a plurality of spaced triangularly positioned drive shaft encircling rings 35 joined by side legs 36. An arm or connector member 37 extends radially outwardly from each ring 35 at each corner of the triangle. In addition, a pair of opposed curved spring arms 38 extend on a common radius from the outer end portion of each connector member and have the usual lugs 39 for interlocking entering notches 19*c* in the respective shear plates 4*c*. Spring arms 38 are thinner than the members 35, 36 and 37, with legs 36 and connector member 37 forming the rigid shear plate stop.

In this embodiment, support member 34 is fixedly secured within the shaver head 2*c* by a bayonet-type connection comprising a multi-armed lock knob 40 which lockingly engages suitable spaced lugs 41 on the inner peripheries of rings 35. Knob 40 may be suitably mounted to shaver head 2*c* in any well-known manner.

The concept of the invention provides a support member comprising a support body fixedly secured to the shaver head and means connected to the body for floatingly supporting the periphery or rim of a shear plate free of the rotary blades and for locking the shear plate against rotation. The support body may also incorporate stop means for limiting inward shear plate movement.

The support member itself is preferably of integral design and may be made of any suitable material which will provide the necessary flexibility and resiliency of the spring arms, and which will also provide the necessary rigidity for the shear plate stop means. Molded polypropylene has been found to be very satisfactory.

While the embodiments described have included two and three point floating shear plate suspensions and stop means, lesser or greater multi-point suspensions and stop means may be utilized without departing from the spirit of the invention.

In addition, certain concepts disclosed in connection with various embodiments may possibly be interchanged.

In all embodiments disclosed, the fixed support member retains the shear plate(s) and cutter member(s) in assembled position within the shaver head, even when the head is removed for cleaning and the like.

Various modes of carrying out the invention are contemplated as being within the scope of the following claims particularly pointing out and distinctly claiming the subject matter which is regarded as the invention.

We claim:

1. A dry shaver comprising:

a. a shaver housing including a shaving head having at least one opening therein, b. a shear plate disposed within said opening and adapted for tilting relative thereto, c. a cutting member disposed adjacent said opening beneath said shear plate and tiltable with the latter, d. and means disposed within said head beneath said shear plate and free of said cutting member for floatingly supporting the periphery of said plate for axial movement therof relative to said opening, e. the periphery of said shear plate freely resting on said floatingly supporting means, f. said floatingly supporting means including locking means cooperating with said shear plate periphery to hold the plate against rotary movement.

2. The shaver of claim 1 in which said shear plate has a transverse shaving face and said supporting means comprises:

a. a transversely extending support body disposed generally parallel to and beneath said shaving face, b. means fixedly mounting said support body within said shaving head,
c. resilient spring means extending horizontally from said support body and supportingly engaging the periphery of said shear plate,
d. and stop means to limit inward floating movement of said shear plate.

3. The shaver of claim 2 in which said stop means comprises a plurality of rigid support body elements disposed beneath the periphery of said shear plate for engagement thereby.

4. A dry shaver comprising:
a. a shaver housing including a shaving head having at least one opening therein,
b. a shear plate having a transverse shaving face and with said shear plate being disposed within said opening and adapted for tilting relative thereto,
c. a cutting member disposed adjacent said opening beneath said shear plate and tiltable with the latter,
d. and means disposed within said head beneath said shear plate and free of said cutting member for floatingly supporting the periphery of said plate for axial movement thereof relative to said opening,
e. the periphery of said shear plate freely resting on said floatingly supporting means,
f. said supporting means comprising:
1. a transversely extending support body disposed generally parallel to and beneath said shaving face,
2. means fixedly mounting said support body within said shaving head,
3. and resilient spring means extending horizontally from said support body and supportingly engaging the periphery of said shear plate.

5. The shaver of claim 4 in which said spring means comprises a plurality of flexible spring arms having their inner ends connected to said support body and having their outer end portions engaging the said periphery of said shear plate.

6. The shaver of claim 5 which includes:
a. a plurality of notches disposed in the peripheral portion of said shear plate,
b. and lug means on the outer end portions of said spring arms and disposed in said notches to lock said shear plate against rotary movement.

7. The shaver of claim 4 in which said support body mounting means comprises:
a. a hub formed in said head,
b. a boss on said support body and mounted over said hub,
c. and means fixedly securing said boss to said hub.

8. The shaver of claim 4 in which said support body mounting means comprises:
a. a multi-armed lock knob mounted in said head,
b. and a plurality of spaced lugs on said support body and with said lugs disposed for locking engagement with the arms of said lock knob.

9. The shaver of claim 4 in which said fixedly mounted supporting means forms retainer means for holding said shear plate and said cutting member in place when said head is removed from the said housing.

10. The shaver of claim 4:
a. in which said support body comprises:
1. a boss mounted to said shaving head,
2. at least one straight element extending outwardly from said boss,
3. and a curved semi-circular element centrally mounted on the end portion of said straight element,
b. and in which said spring means comprises flexible spring arms having their inner ends connected to the outer end portions of said semi-circular element and having their outer end portions engaging the said periphery of said shear plate.

11. The shaver of claim 4 which includes a plurality of shear plates and cutting members:
a. in which said support body comprises:
1. a boss mounted to said shaving head,
2. a plurality of segmental straight outer side members,
3. and connector means extending between said boss and said side members,
b. and in which said spring means comprises a plurality of spring arms having their inner ends connected to said connector means and having their outer end portions engaging the periphery of the respective shear plate.

12. The shaver of claim 11:
a. wherein said connector means comprises:
1. a ring adapted to surround the drive shaft for each said cutting member,
2. and a plurality of connector arms radiating outwardly from said ring with at least one of said arms being connected to said boss and with another of said arms being connected to the end portion of a said straight outer side member,
b. and in which said spring arms are connected at their inner ends to said connector arms.

13. The shaver of claim 12 in which said support body includes rigid portions disposed beneath the peripheries of the respective shear plates for engagement thereby to limit inward floating movement thereof.

14. The shaver of claim 4 which includes a plurality of shear plates and cutting members:
a. in which said support body comprises:
1. a plurality of rings adapted to surround the drive shaft for each said cutting member,
2. side legs joining said rings,
3. and a connector member extending outwardly from each said ring,
b. and in which said spring means comprises a plurality of spring arms having their inner ends connected to said connector member and having their outer end portions engaging the periphery of the respective shear plate.

15. The shaver of claim 14 in which said support body includes rigid portions disposed beneath the peripheries of the respective shear plates for engagement thereby to limit inward floating movement thereof.

16. A dry shaver comprising:
a. a shaver housing including a shaving head having at least one opening therein,
b. at least one shear plate disposed within said opening and adapted for tilting relative thereto,
c. a plurality of notches disposed in the peripheral portion of said shear plate,
d. a cutting member disposed adjacent said opening beneath said shear plate and tiltable with the latter,
e. a support body,
f. a plurality of horizontally extending flexible spring arms having their inner ends connected to said support body and having their outer end portions disposed to floatingly support the periphery of said shear plate, g. the said outer end portions of said spring arms forming ligs disposed within said shear plate notches to lock the plate against rotary movement, h. and means fixedly mounting said support body within said shaver head so that said body and said spring arms hold said shear plate and said cutting member in place when said head is removed from said housing.

17. The shaver of claim 16 which includes stop means to limit inward floating movement of said shear plate and comprising a plurality of rigid support body elements disposed beneath the periphery of said shear plate for engagement thereby.

18. A dry shaver comprising:

a. a shaver housing including a removable shaving head having at least one opening therein, b. a shear plate disposed within said opening and adapted for tilting relative thereto, c. a floating rotary cutting member disposed adjacent said opening beneath said shear plate and tiltably supporting the latter, d. and means removably secured in said head to retain the cutting member and shear plate in assembly in said shaving head when the latter is removed from said housing, e. said retaining means interlocking with said shear plate to prevent rotation of the latter without interfering with its tilting action, f. said interlock including a lug on said retaining means and which is tiltable with said shear plate.

19. A dry shaver comprising:

a. a shaver housing including a shaving head having at least one opening therein, b. at least one shear plate disposed within said opening and adapted for tilting relative thereto, c. a plurality of notches disposed in the peripheral portion of said shear plate, d. a cutting member disposed adjacent said opening beneath said shear plate and tiltable with the latter, e. a support body, f. a plurality of horizontally extending flexible spring arms having their inner ends connected to said support body and having their outer end portions disposed to floatingly support the periphery of said shear plate, g. the said outer end portions of said spring arms forming lugs disposed within said shear plate notches to lock the plate against rotary movement, and h. means fixedly mounting said support body within said shaver head so that said body and said spring arms hold said shear plate in place when said head is removed from said housing.

* * * * *